United States Patent [19]

Vaaler

[11] Patent Number: 4,786,376

[45] Date of Patent: Nov. 22, 1988

[54] ELECTRODEPOSITION WITHOUT INTERNAL DEPOSIT STRESS

[75] Inventor: Luther E. Vaaler, Burbank, Calif.

[73] Assignee: The United States of America as represented by the Secretary of the Air Force, Washington, D.C.

[21] Appl. No.: 142,472

[22] Filed: Jan. 5, 1988

[51] Int. Cl.[4] ..... C25D 1/00; C25D 17/00

[52] U.S. Cl. ..... 204/3; 204/231

[58] Field of Search ..... 204/1 T, 3, 4, 231, 204/434

[56] References Cited

U.S. PATENT DOCUMENTS

| | | | |
|---|---|---|---|
| 2,706,170 | 4/1955 | Marchese | 204/3 |
| 3,437,568 | 4/1969 | Hasselmann et al. | 204/3 |
| 3,485,725 | 12/1969 | Koretzky | 204/38 |
| 3,570,449 | 3/1971 | Blecherman et al. | 118/9 |
| 3,876,510 | 4/1975 | Wallin et al. | 204/9 |
| 3,954,568 | 5/1976 | DuPree | 204/9 |
| 3,963,587 | 6/1976 | Kreckel | 204/9 |
| 4,501,646 | 2/1985 | Herbert | 204/4 |
| 4,648,944 | 3/1987 | George et al. | 204/1 T |

*Primary Examiner*—T. M. Tufariello

*Attorney, Agent, or Firm*—Donald J. Singer; Fredric L. Sinder

[57] ABSTRACT

An apparatus and method are described for electrodepositing an electroform with near zero internal stress. A voltage controlled power supply supplies current to both a mandrel, upon which a primary electroform is deposited, and to a deformable thin disk substrate, upon which a secondary deposit is formed. A strain gage on the deformable substrate measures any deformation caused by internal stress in the secondary deposit. The strain gage is connected to a strain gage transducer to produce an output signal to a proportional controller. The proportional controller in turn supplies a strain-proportional voltage signal to the power supply. A current mask ensures an even current density over the mandrel. After initially adjusting electroforming bath parameters to provide a zero internal stress in the starting electroform, the output from the strain gage causes proportional changes in the bath current to the mandrel to maintain a constant near zero internal stress in the primary electroform.

3 Claims, 3 Drawing Sheets

ELECTRODEPOSITION WITHOUT INTERNAL DEPOSIT STRESS

RIGHTS OF THE GOVERNMENT

The invention described herein may be manufactured and used by or for the Government of the United States for all governmental purposes without the payment of any royalty.

BACKGROUND OF THE INVENTION

This invention relates generally to electroforming, and more specifically to an apparatus and method for electrodepositing electroforms without internal stress.

Electroforming is a variation of electroplating involving the formation of a removable layer of metal which conforms exactly to the shape of the surface of a master. A primary problem in making electroforms is that internal stresses, usually tensile, are created in the deposit during electrodeposition. The internal stresses can cause deformation both during electrodeposition and after parting from the master. Many attempted advances in the electroforming art have been directed toward minimizing internal stresses in the electrodeposit.

Nickel or copper are common choices for electroforming. The considerable experience with electroforming nickel, especially with methods of depositing it with low internal stress, and its relatively high strength, make it the usual material of choice for electroforming.

Nickel electroforming has been performed with a wide variety of plating baths, including those containing nickel salts of sulfate and chloride (Watt's type), fluoborate, and sulfamate. The nickel sulfamate bath, first used around 1950, has become more and more the usual choice for electroforming due to its relatively low stress deposits. A nickel sulfamate bath, however, only reduces the internal tensile stress. The prior art has developed a number of additives to nickel sulfamate baths that further reduce the internal stress and, in some cases, reverse the stress to a compressive one. Some specific additive stress reducers are saccharin, naphthalenetrisulfonic acid and paratoluene sulphonamide. Small amounts of these stress reducers appear to become incorporated in the deposit. The prior art uses primarily proprietary derivatives of these additive stress reducers.

Other factors affect internal stress in the deposit including, for example, current density, temperature, nickel concentration and agitation. For given conditions of these other electrodeposition factors, there is a critical concentration of additive stress reducers that will provide zero internal stress. Unfortunately, the plating, or electroforming, bath is not completely stable in this regard due to slight decomposition of the stress reducer, its incorporation into the deposit, introduction of other minor impurities into the deposit and the general difficulty of precisely controlling deposition conditions.

The prior art has discovered that, at a combination of electroforming factors producing a nearly zero internal stress in a developing electroform, slight variations in one factor, or parameter, can proportionally move the internal stress from tensile to compressive and back again. It has been particularly found that slight changes in current from the anode to the cathodic mandrel, or master, will move the internal stress in a generally proportional direction around the zero stress point.

Measurement of internal stress during electroformation is difficult because most mandrels are made rigid to resist deformation from internal stress, thereby preventing any measurable deformation in the developing electrodeposit. The prior art has provided deformable devices to measure internal stress in a secondary electroform as an analog to the internal stress in a primary electroform on a rigid mandrel. An example is a Brenner-Senderoff spiral contractometer. It uses a flat strip of metal formed into a spiral coil. One side of the coil is painted or otherwise treated so that a deposit will form only on the outside of the coil. Internal stresses in the deposit tighten or loosen the coil to turn a rod at the coil axis which is connected to a gear and dial to magnify the rotation of the rod and produce a reading proportional to internal stress in the deposit. Typically, the prior art has used the Brenner-Senderoff spiral contractometer only to take periodic readings of internal stress for manually adjusting the electroforming bath parameters.

U.S. Pat. No. 4,648,944 to George et al describes the use of a complex strain gage assembly immersed inside the electroforming bath as a second cathode for receiving a secondary electrodeposit. A separate power supply provides current for forming the secondary deposit. The strain gage indicates any internal stress in the secondary deposit and supplies an output to a programmed micro-computer which proportionally controls the power supply for the primary electrodeposit to return the internal stress in the primary electrodeposit to zero. George et al uses a very complicated strain gage assembly and microcomputer program to achieve a near zero internal stress electrodeposited electroform. Further, the stress measured by the strain gage assembly may not be an exact analog to the stress in the developing primary electroform.

It is seen, therefore, that there is a need for an improved and simpler electroforming apparatus and method that produces deposits with near zero internal stress.

It is, therefore, a principal object of the present invention to provide an improved and simpler electroforming apparatus and method for measuring the internal stress of an electrodeposit and dynamically adjusting electrodeposition parameters to maintain the internal stress near zero.

It is another object of the present invention to provide an improved apparatus and method for electroforming deposits with near zero internal stress that provides a more even distribution of current density over the developing electroform deposit.

It is a feature of the present invention that its strain gage assembly provides an improved correspondence of measured internal stress with actual stress in the primary deposit.

SUMMARY OF THE INVENTION

The present invention provides a method for determining the internal stress of an electroform deposit and dynamically adjusting the current density in the electroforming bath to maintain the internal stress near zero. The unique discovery of the present invention comprises improvements to the technique of electroforming a secondary deposit onto a deformable substrate at the same time as the desired primary electroform is deposited onto a master, measuring the secondary deposit internal stress from its deformation and using the measured second deposit internal stress to provide a feedback signal to dynamically adjust the bath current to maintain the internal stress in both the secondary and primary deposits near zero. The improvements include a simple analog feedback circuit, a simple thin disc deformable substrate, and the use of a current mask to provide more even distribution of current density.

Accordingly, the present invention is directed to an apparatus and method for electroforming a first electrodeposit onto a rigid mandrel with minimum internal stress. The invention includes a thin disk deformable substrate, a strain gage attached to a back of the deformable substrate, a non-conductive coating covering the strain gage and back of the deformable substrate, voltage controlled power supply means for supplying direct current through the bath from the anode means to both a front face of the mandrel and a front face of the deformable substrate, means for controlling the current from the power supply means so that the current density over the front faces of both the mandrel and the deformable substrate is substantially the same, an insulated barrier inside the bath separating the anode means from the mandrel and the deformable substrate, the insulated barrier having a pair of window openings each positioned near to and sized slightly smaller than, respectively, the mandrel and the deformable substrate, and transducer-controller means for producing an output voltage generally proportional to a strain measured by the strain gage.

The invention may additionally include an insulating baffle in the bath separating the mandrel from the deformable substrate.

DESCRIPTION OF THE DRAWINGS

The invention will be more clearly understood from a reading of the following detailed description in conjunction with the accompanying drawings wherein.

DETAILED DESCRIPTION

Figure 1:
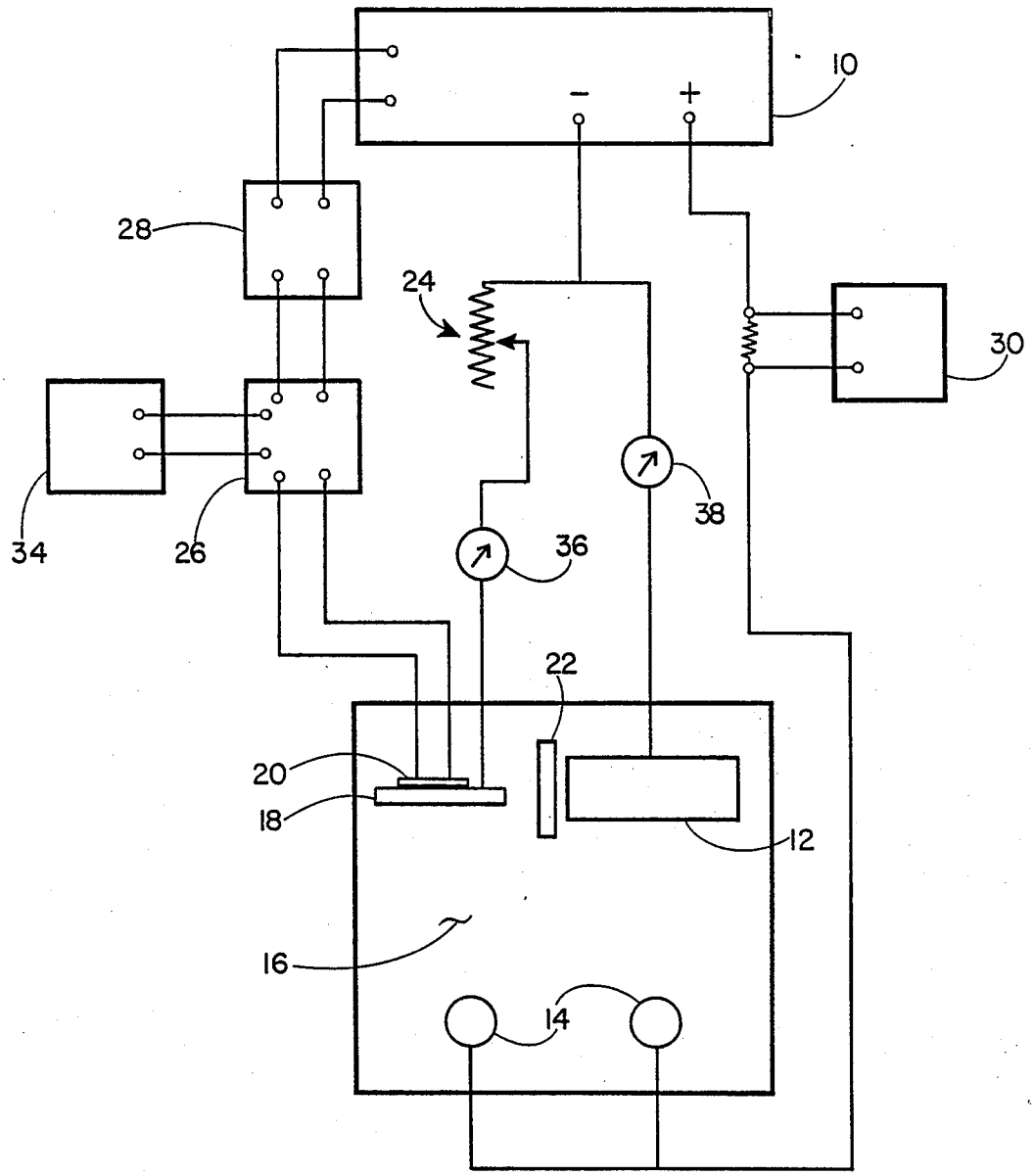
FIG. 1 is a schematic view of an electroforming bath and accompanying automatic deposit internal stress control apparatus and circuitry according to some of the teachings of the present invention.

Referring now to FIG. 1 of the drawings, there is shown a schematic view of an electroforming apparatus according to some of the teachings of the present invention. The electroforming apparatus primarily includes a voltage controlled power supply 10 which supplies current to a mandrel 12 (the electroform master) and to anodes 14. Mandrel 12 and anodes 14 are immersed in a nickel sulfamate electroforming bath 16. During electrodeposition, nickel is precipitated from the nickel salts in bath 16 onto cathodic mandrel 12 to form the desired electroform in a mirror image of the surface shape of mandrel 12.

A flexible thin metal strip, or deformable substrate 18, to which is attached a strain gage 20, is also immersed in bath 16, physically separated in the bath from andrel 12 by baffle 22. Substrate 18 is also attached as a cathode to power supply 10, but through variable resistor 24 which divides the current between mandrel 12 and substrate 18 to provide equal current density to each of their surfaces. Strain gage 20 connects to strain gage transducer 26 which connects to proportional controller 28 to supply to power supply 10 a voltage proportional to the output of strain gage transducer 26. The proportional voltage thereby proportionally controls the power supply 10 output current, and the resulting current density over mandrel 12 and substrate 18.

A current recorder 30 is shunted across the anode 14 leads to provide a history of the total current through the system. A microstrain recorder 34 provides a history of deformations of substrate 18 as indicated by strain gage 20. Ammeters 36 and 38 facilitate adjustment of variable resistor 24 to provide equal current density to mandrel 12 and substrate 18.

In operation, electrodeposition parameters are first chosen from prior experience so that sufficient added stress reducer will reduce electrodeposit internal stress to near zero. Current density, controlled by the voltage output from proportional controller 28, is then adjusted to a level estimated by experiment, or by use of a spiral contractometer, to provide near zero internal stress. It is not necessary that the initial parameter settings provide a perfectly stress-free initial deposit. The apparatus, as described below, will adjust current density in response to strains measured by strain gage 20 to achieve a stress-free deposit. After start-up, increases and decreases in measured strain in deformable substrate 18 will automatically raise and lower the voltage output of proportional controller 28 to raise and lower the current output of power supply 10, and the resulting current density to substrate 18, until the measured strain in substrate 18, and the corresponding stress in the primary electrodeposit, reaches zero.

Figure 2:
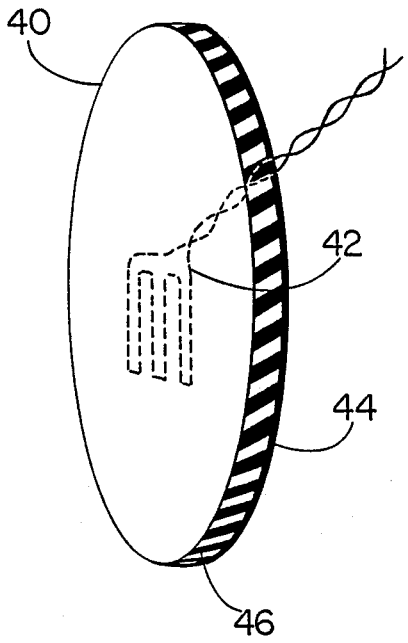
FIG. 2 is a representational view of a preferred embodiment of a deformable substrate in the shape of a thin disk, with a strain gage attached for measuring deformation of the substrate; and, FIG. 3 is a perspective view of a preferred embodiment of the invention showing the use of a thin disk deformable substrate and a current mask to control deposition.

FIG. 2 is a representational view of a preferred embodiment of a deformable substrate 40 in the shape of a thin disk. It has been found easier to maintain an uniform current density over the surface of a circular deformable substrate than over the surface of another shape, particularly the rectangular shapes seen in the prior art. The circular shape avoids sharp corners that can draw high currents that build areas of excessive thickness in the deposit and which can lead to nodule formation and dendrite type structures. A strain gage 42 is attached onto the center of the back face of thin disk substrate 40 to provide an uniform reading of the internal stress in a deposit forming on the front face of the substrate. The back face and sides of substrate 40, and strain gage 42, are painted with an insulating paint or lacquer 44 to confine electrodeposition to the uncoated front side of the substrate. Tape 46 may be used in place of or in addition to paint, lacquer or other coating.

Figure 3:
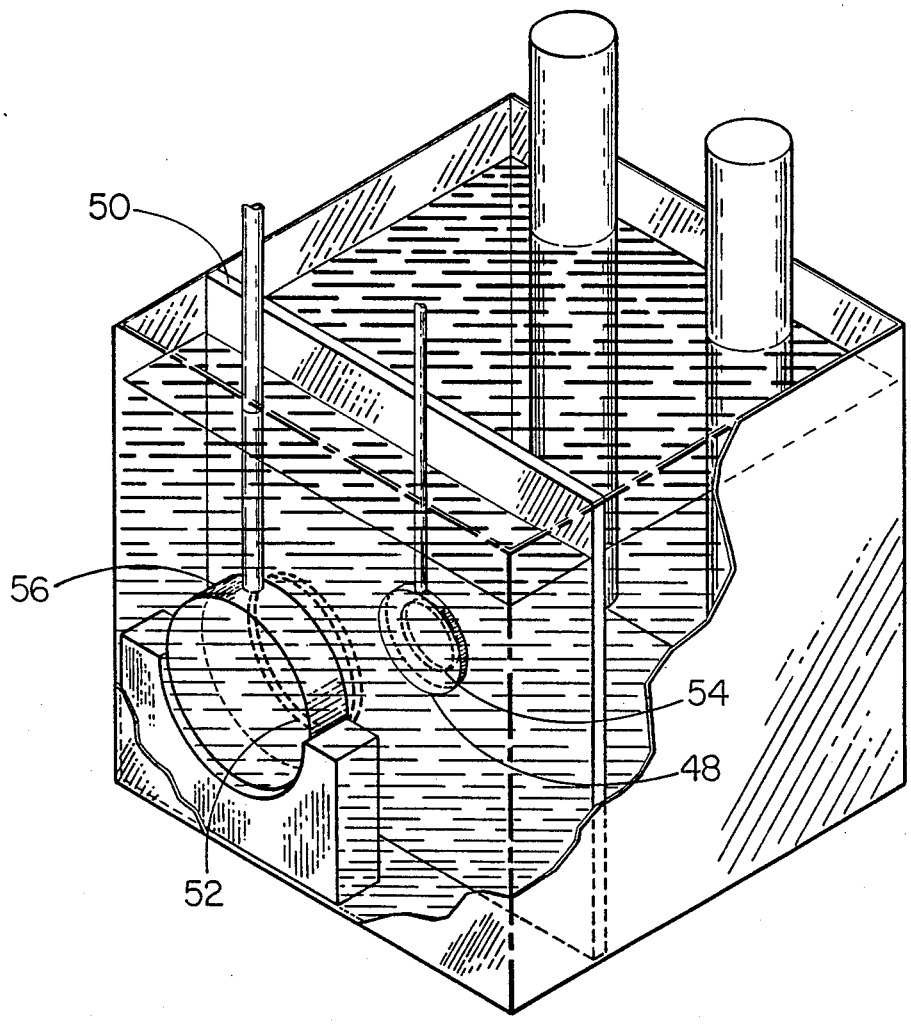

FIG. 3 is a perspective view of a preferred embodiment of the invention showing the use of a thin disk substrate 48 and a current mask 50. Current mask 50 includes windows 52 and 54, or openings, adjacent to and sized slightly smaller than a mandrel 56 and thin deformable substrate 48. The use of a current mask and windows provides a significantly more uniform current density and deposit distribution, greatly improving the usefulness of the method. The size of the windows and their distance from a mandrel are generally determined as a percentage of the size of the mandrel. A suitable ratio for window diameter over circular mandrel diameter is 0.74 and a suitable ratio of the spacing of the window from a circular mandrel over the mandrel diameter is 0.24.

In a specific example, deformable substrate 48 was 3 inches in diameter with a strain gage mounted in the center of the back of the substrate. The back was painted over to confine electrodeposition to the front side of substrate 48. Rigid mandrel 56 was 7 inches in diameter and 1½ inches thick and painted on its back and sides. Electrodeposits from 5 to 40 mils thick were successfully deposited with their internal stress controlled at zero by the described technique.

Improved uniformity of current density over the thin disk substrate to improve the accuracy of the general method may also be achieved by the use of other means, such as a guard ring around the disk. A guard ring is a conductive annular ring surrounding the disk and electrically isolated from it. A separately controlled current flows to the guard ring to create a separate electrodeposit over its surface. The current to the guard ring draws current away from the edges of the disk to avoid edge effects and permit greater uniformity of current density over the face of the disk.

The described invention uses a simple voltage divider to distribute current to the mandrel and the strain measurement device. While this system has worked satisfactorily, a more reliable apparatus may include the use of two proportional controllers and two voltage sensitive power supplies. Those with skill in the art of the invention will see that means incorporating two controllers and power supplies, and accompanying controls for maintaining equal current density over the thin disk and the mandrel, is a functional equivalent to the disclosed voltage divider circuit.

The disclosed apparatus and method for making electroforms without internal stress successfully demonstrates improvements to the method of electrodepositing a secondary electrodeposit onto a strain gage equipped deformable substrate to provide a feedback signal for controlling the current density, and proportionally the internal stress, to a primary electroform being electrodeposited onto a rigid master. The use of a simple analog feedback circuit, a simple thin disk deformable substrate and a current mask to provide more even distribution of current density will expand the use and usefulness of the general method. These teachings may be easily extended to other arts where similar process problems exist.

It is understood that certain modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

I claim:

1. An apparatus for electroforming a first electrodeposit onto a rigid mandrel with minimum internal stress during its formation, the mandrel and anode means immersed inside a metal-containing bath; comprising:

(a) a deformable substrate for receiving a second electrodeposit, the deformable substrate immersed inside the bath and having the shape of a thin disk;

(b) a strain gage attached to a back face of the deformable substrate;

(c) a non-conductive coating over the strain gage and the back face of the deformable substrate;

(d) voltage controlled power supply means for supplying direct current through the bath from the anode means to both a front face of the mandrel and a front face of the deformable substrate;

(e) means for controlling the current from the power supply means to both the mandrel and the deformable substrate so that the current densities over the front faces of both the mandrel and the deformable substrate are substantially the same;

(f) an insulated barrier inside the bath separating the anode means from both the mandrel and the deformable substrate, the insulated barrier having a pair of windows each positioned near to and sized slightly smaller than, respectively, the mandrel and the deformable substrate; and, (g) transducer-controller means for producing an output voltage generally proportional to a strain measured by the strain gage, the transducer-controller means having an input connected to the strain gage and an output connected to the power supply means for changing the output current of the power supply means generally in proportion to strains measured by the strain gage.

2. The apparatus according to claim 1, further comprising a baffle in the bath separating the mandrel from the deformable substrate.

3. A method for electroforming a first electrodeposit onto a rigid mandrel with minimum internal stress during its formation, the mandrel and anode means immersed inside a metal-containing bath; comprising the steps of:

(a) providing a deformable substrate for receiving a second electrodeposit, the deformable substrate immersed inside the bath and having the shape of a thin disk;

(b) providing a strain gage attached to a back face of the deformable substrate;

(c) providing a non-conductive coating over the strain gage and the back face of the deformable substrate;

(d) providing a voltage controlled power supply means for supplying direct current through the bath from the anode means to both a front face of the mandrel and a front face of the deformable substrate;

(e) controlling the current from the power supply means so that the current densities over the front faces of both the mandrel and the deformable substrate are substantially the same;

(f) providing an insulated barrier inside the bath separating the anode means from both the mandrel and the deformable substrate, the insulated barrier having a pair of windows each positioned near to and sized slightly smaller than, respectively, the mandrel and the deformable substrate;

(g) providing transducer-controller means for producing an output voltage generally proportional to a strain measured by the strain gage, wherein the transducer-controller means has an input connected to the strain gage and an output connected to the power supply means for changing the output current of the power supply means generally in proportion to strains measured by the strain gage;

(h) beginning a simultaneous electroforming of electrodeposits onto the front faces of both the mandrel and the deformable substrate and adjusting the output of the transducer-controller means to a preselected setting corresponding to an estimate of a near zero internal stress in the first electrodeposit; and, (i) continuing simultaneous electroforming of electrodeposits onto the front faces of the mandrel and the deformable substrate so that an internal stress in the second electrodeposit will deform the deformable substrate, thereby producing a strain measured by the strain gage and a proportional change in the voltage to the power supply means to change its output current to cause the internal stress in the first electrodeposit to approach zero.

* * * * *